US006962134B1

(12) United States Patent
Douse

(10) Patent No.: US 6,962,134 B1
(45) Date of Patent: Nov. 8, 2005

(54) ROCKER ARM SHAFT RETAINER AND ASSEMBLY

(75) Inventor: Eric C. Douse, Pontiac, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/912,620

(22) Filed: Aug. 5, 2004

(51) Int. Cl.[7] ..... F01M 1/06
(52) U.S. Cl. ..... 123/90.36; 123/90.38; 123/90.37; 123/90.39; 123/195 A; 123/198 E; 74/569; 29/888.2
(58) Field of Search ..... 123/90.36, 90.37, 123/90.38, 90.39

(56) References Cited

U.S. PATENT DOCUMENTS 4,653,441 A * 3/1987 Belsanti ..... 123/90.39
4,724,804 A * 2/1988 Wirth ..... 123/90.39
4,724,805 A * 2/1988 Wirth et al. ..... 123/90.39
6,041,750 A * 3/2000 Miller ..... 123/193.5

* cited by examiner

*Primary Examiner*—Thomas Denion
*Assistant Examiner*—Kyle M. Riddle
(74) *Attorney, Agent, or Firm*—Christopher DeVries

(57) ABSTRACT

A rocker arm shaft retainer includes an elongated contoured sheet-like body having two opposite ends, two opposite sides longer in length than the ends, and a central portion between the sides. A plurality of fingers extend from the central portion towards the sides and each finger has a contoured recess for engaging a rocker shaft. The fingers define slots for receiving rocker arms. The retainer further includes a plurality of thrust faces along edges of the fingers for axial positioning of rocker arms on a rocker shaft. A plurality of bosses are also disposed on the fingers, each of the bosses having a generally flat surface.

3 Claims, 4 Drawing Sheets

26
26
26
26
26
34
56
42
12
32
56
36
42
56
54
44
56
42
54
44
42
56
54
44
42
56
44
42
44
42
56
44
42
44
42
56
44
42
56
30
38
56
44
42
44
42
56
42
24
58
24
58
24
58

ROCKER ARM SHAFT RETAINER AND ASSEMBLY

TECHNICAL FIELD

This invention relates to internal combustion engines, and more particularly to internal combustion engines utilizing rocker arm and shaft-type valvetrains.

BACKGROUND OF THE INVENTION

It is known in the art relating to internal combustion engines to utilize rocker arm and shaft-type valvetrains. In this type of valvetrain, it is necessary to retain the rocker arm shafts and properly space the rocker arms on the rocker shafts. Several different conventional methods exist to retain the rocker shafts and to maintain rocker spacing. These include using clamping blocks to retain the rocker shafts and spacers to axially position the rocker arms. Other systems use springs to thrust the rocker arms against a machined face on the cylinder head or some secondary casting thereof.

These conventional systems require the use of a multitude of parts for the retention of the rocker arm shafts and the axial positioning of the rocker arms. Further, conventional systems also require additional machining of parts. Machining and the need for multiple parts increases the cost of positioning and retaining the rocker arms and rocker arm shafts and of assembling these components into an engine.

SUMMARY OF THE INVENTION

The present invention provides a rocker arm shaft retainer for the retention of engine rocker arm shafts of an internal combustion engine to an engine cylinder head or a subassembly thereof. The rocker arm shaft retainer also provides for axial positioning of the engine rocker arms on the shafts.

In an exemplary embodiment, a rocker arm shaft and rocker arm assembly in accordance with the present invention includes a lifter oil manifold that carries hydraulic valve lifters and cylinder deactivation components. The lifter oil manifold also includes at least one mounting and a lifter oil feed pipe mounted to the mounting. The assembly further includes two rocker arm shafts and a plurality of rocker arms disposed on each of the rocker arm shafts. Fasteners fasten the rocker arm shaft retainer to the rocker arm shafts and fasten the rocker arm shafts to the lifter oil manifold, thereby retaining the rocker arm shafts in the assembly.

The assembly may include twelve rocker arms. Four of the rocker arms may be disposed on one rocker arm shaft and eight of the rocker arms may be disposed on the other rocker arm shaft offset longitudinally from each of the four rocker arms. The four rocker arms may be exhaust rockers and the eight rocker arms may be intake rockers. The lifter oil feed pipe may be spacedly mounted to the lifter oil manifold, the lifter oil feed pipe being disposed above the retainer.

The rocker arm shaft retainer itself includes an elongated contoured sheet-like body having two opposite ends, two opposite sides longer in length than the ends, and a central portion between the sides. A plurality of fingers extend from the central portion to the sides. Each finger has a contoured recess for engaging one of the rocker arm shafts. The fingers define slots for receiving the rocker arms. A plurality of thrust faces along edges of the fingers provide for axial positioning of the rocker arms on the rocker shafts. A plurality of bosses are disposed on the fingers. Each of the bosses has a generally flat surface.

The central portion of the retainer may include at least one opening therein. At least one finger may include more than one boss. Each boss may include an aperture therethrough. The slots formed along one side of the sheet-like body may be offset longitudinally from the slots formed along the opposite side of the sheet-like body. The retainer may include fourteen fingers and twelve slots. Eight of the slots may be formed along one side of the sheet-like body and four of the slots may be formed along the opposite side of the sheet-like body offset from each of the eight slots. Further, the sheet-like body may have a curvilinear cross-section.

In the rocker arm shaft and rocker arm assembly, the at least one mounting for the lifter oil feed pipe may extend through one of the openings in the central portion of the retainer. Each of the rocker arm shafts includes apertures therethrough correspondingly disposed in relation to the apertures of the bosses along one of the sides of the sheet-like body. The rocker arm shaft retainer mates with the rocker arm shafts along the recesses of the fingers. The rocker arms are received in the slots of the retainer, the apertures of the rocker arm shafts are aligned with the apertures of the bosses, and each of the fasteners is inserted through one of the apertures of the bosses and corresponding apertures of the rocker arm shafts, thereby positioning the rocker arms along each of the rocker arm shafts.

These and other features and advantages of the invention will be more fully understood from the following description of certain specific embodiments of the invention taken together with the accompanying drawings.

DESCRIPTION OF THE PREFERRED EMBODIMENT

Figure 1:
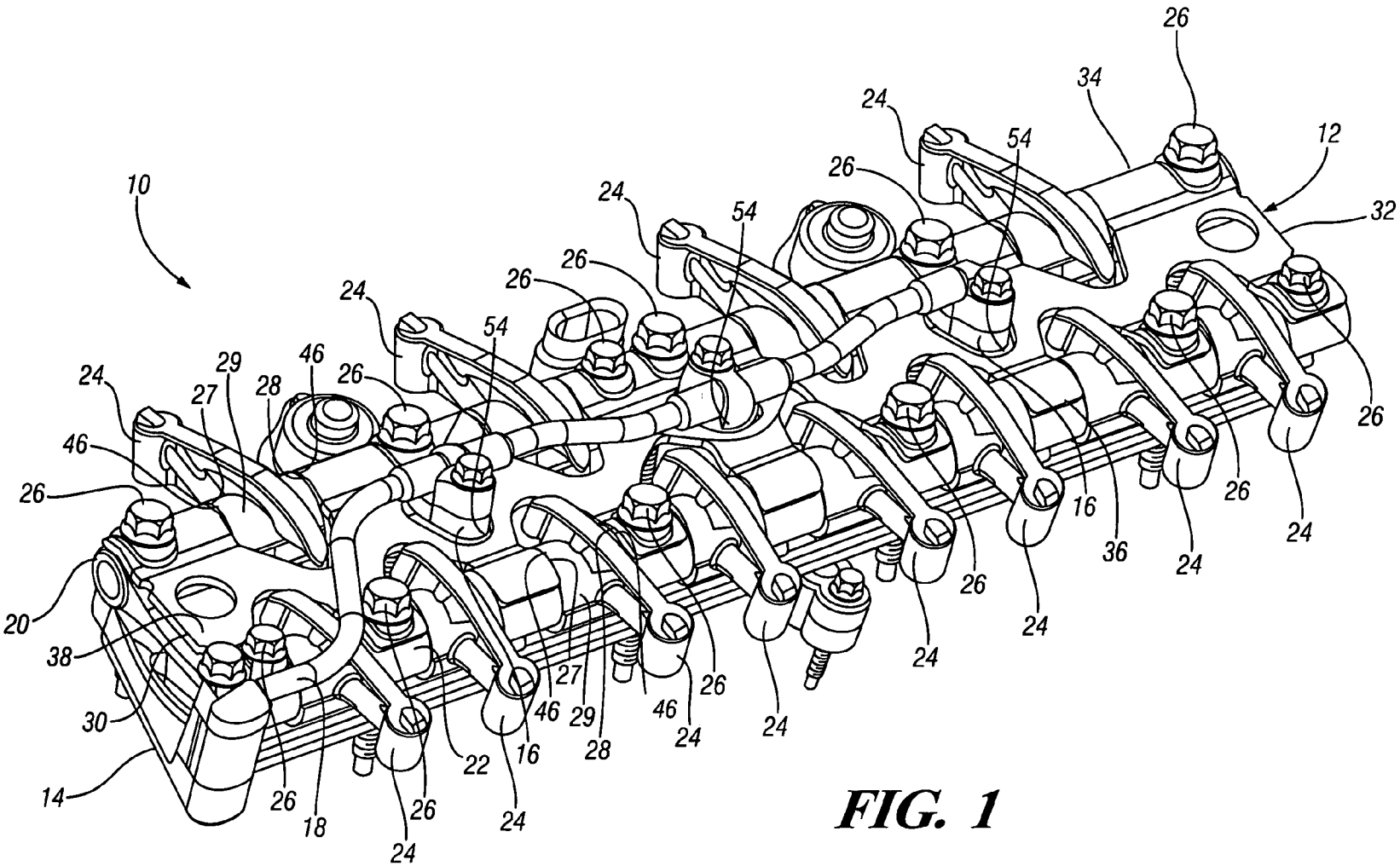
FIG. 1 is a perspective view of a rocker arm shaft and rocker arm assembly including a rocker arm shaft retainer in accordance with the present invention fastened to a lifter oil manifold of an internal combustion engine.

Referring now to the drawings in detail, numeral 10 generally indicates a rocker arm shaft and rocker arm assembly for use in an internal combustion engine. The assembly 10 includes a rocker arm shaft retainer 12 in accordance with the present invention. The rocker arm shaft retainer 12 is a single member design that provides for the retention of engine rocker arm shafts and for the axial positioning of engine rocker arms on the rocker arm shafts.

Figure 2:
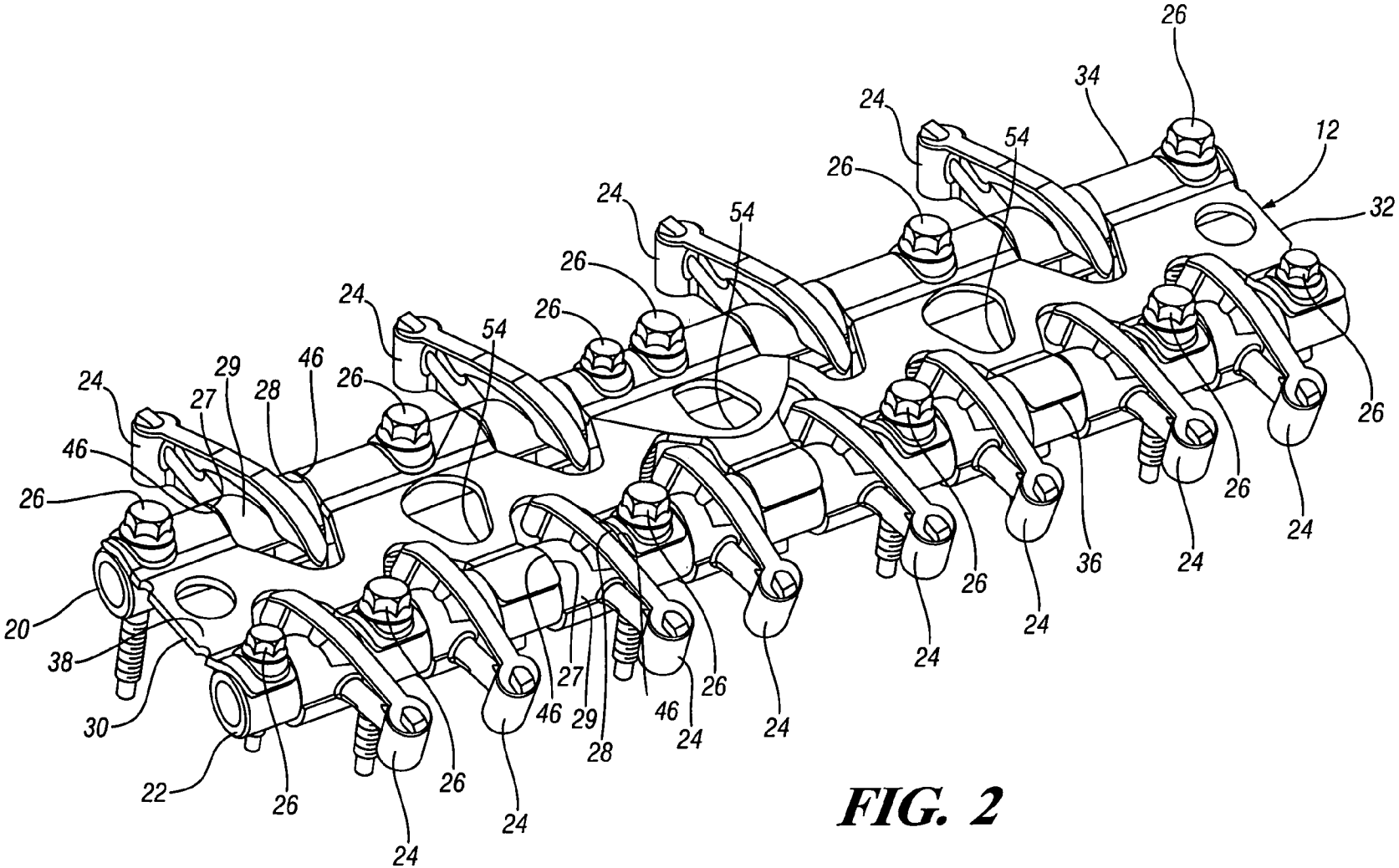
FIG. 2 is a perspective view of the rocker arm shaft and rocker arm assembly of FIG. 1 including the rocker arm shaft retainer.
Figure 3:
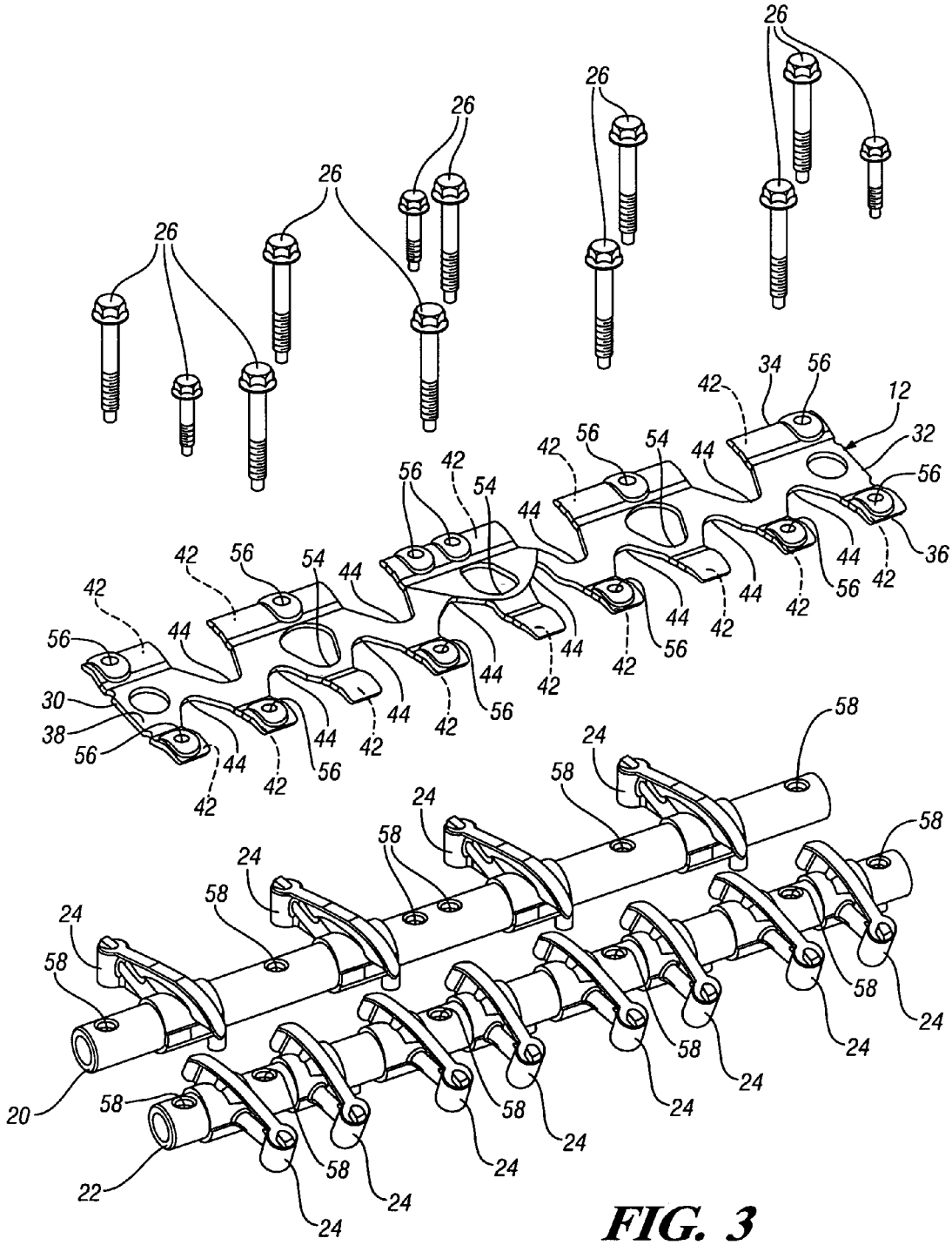
FIG. 3 is an exploded view of FIG. 2.

With reference to FIGS. 1 through 3, the rocker arm shaft and rocker arm assembly 10 includes a lifter oil manifold 14 that carries hydraulic valve lifters and cylinder deactivation components (not shown). The lifter oil manifold 14 also includes at least one mounting 16 and a lifter oil feed pipe 18 mounted to the mounting 16. The assembly 10 further includes two rocker arm shafts 20, 22 and a plurality of rocker arms 24 disposed on each of the rocker arm shafts 20, 22. Fasteners 26 fasten the rocker arm shaft retainer 12 to the rocker arm shafts 20, 22 and the rocker arm shafts 20, 22 to the lifter oil manifold 14, thereby retaining the rocker arm shafts 20, 22 in the assembly 10.

In the embodiment shown in the drawings, the assembly 10 is adapted for use with a V8 internal combustion engine having three valves per cylinder, two of which are intake valves and one of which is an exhaust valve. The assembly 10 and the corresponding rocker arm shaft retainer 12, may, however, be adapted for use with a variety of rocker arm and shaft type internal combustion engine valvetrains. The use of the assembly 10 simplifies the installation of the components of the assembly 10 into an internal combustion engine.

In this arrangement, the assembly 10 may include twelve rocker arms 24. Four of the rocker arms 24 may be disposed on one rocker arm shaft 20 and eight of the rocker arms 24 may be disposed on the other rocker arm shaft 22 offset longitudinally from each of the four rocker arms 24. The four rocker arms 24 may be exhaust rockers and the eight rocker arms 24 may be intake rockers. The lifter oil feed pipe 18 may be spacedly mounted to the lifter oil manifold 14, the lifter oil feed pipe 18 being disposed above the retainer 12.

Figure 4:
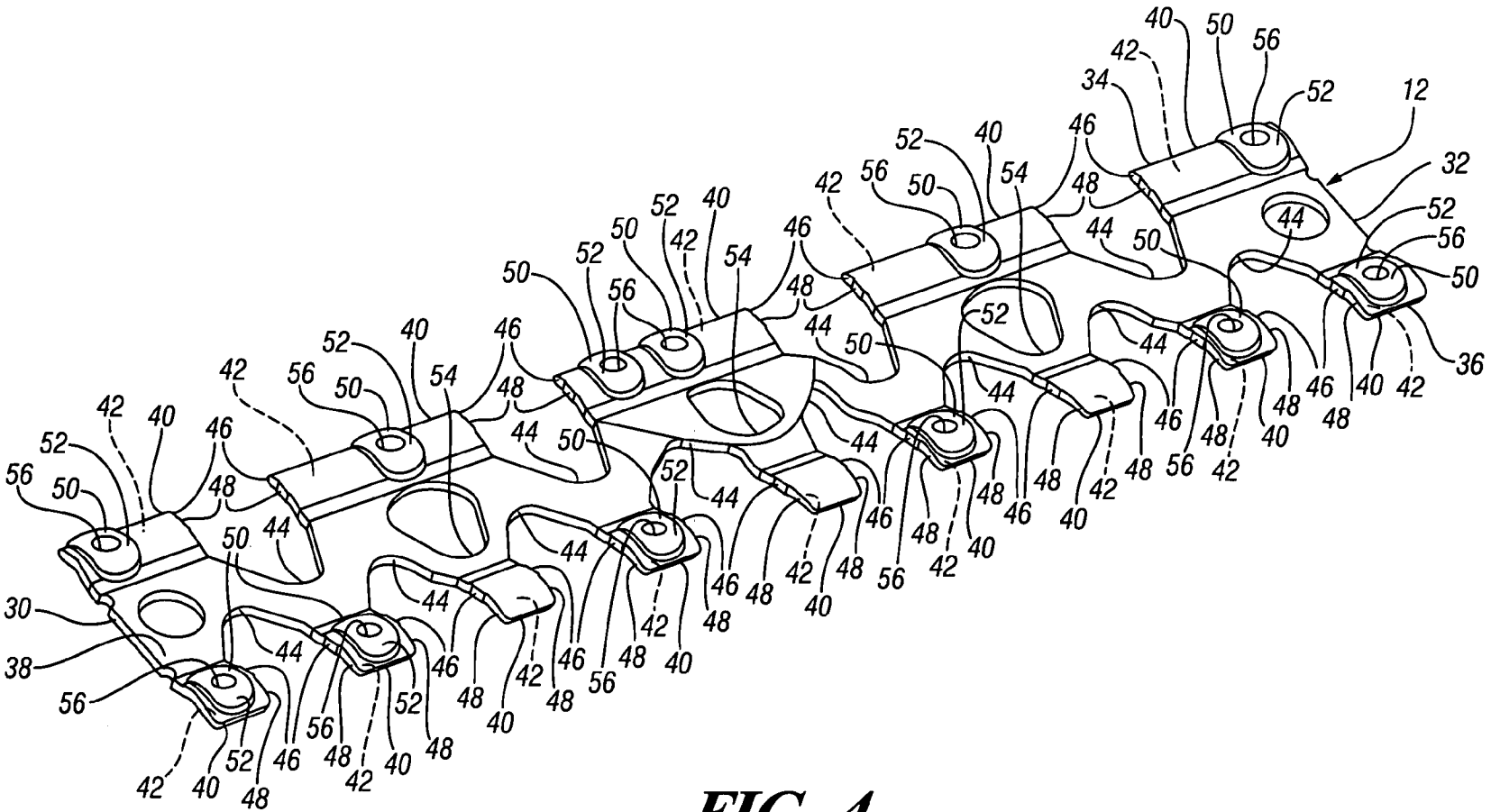
FIG. 4 is a perspective view of the rocker arm shaft retainer of FIG. 1.

Turning now to FIG. 4, the rocker arm shaft retainer 12 includes an elongated contoured sheet-like body having two opposite ends 30, 32, two opposite sides 34, 36 longer in length than the ends 30, 32, and a central portion 38 between the sides 34, 36. A plurality of fingers 40 extend from the central portion 38 to the sides 34, 36. Each finger 40 has a contoured recess 42 for engaging one of the rocker arm shafts 20, 22. The fingers 40 define slots 44 for receiving the rocker arms 24. A plurality of thrust faces 46 along edges 48 of the fingers 40 provide for axial positioning of the rocker arms 24 on the rocker shafts 20, 22 by engaging edges 27, 28 of a pivot 29 of each rocker arm 24. A plurality of bosses 50 are disposed on the fingers 40. Each of the bosses 50 has a generally flat surface 52.

In an exemplary embodiment, the central portion 38 may include at least one opening 54 therein. At least one finger 40 may include more than one boss 50. Each boss 50 may include an aperture 56 therethrough. The slots 44 formed along one side 34 of the sheet-like body may be offset longitudinally from the slots 44 formed along the opposite side 36 of the sheet-like body. The retainer 12 may include fourteen fingers 40 and twelve slots 44. Eight of the slots 44 may be formed along one side 34 of the sheet-like body and four of the slots 44 may be formed along the opposite side 36 of the sheet-like body offset longitudinally from each of the eight slots. Further, the sheet-like body may have a curvilinear cross-section.

Returning to the rocker arm shaft and rocker arm assembly, the at least one mounting 16 for the lifter oil feed pipe 18 may extend through one of the openings 54 in the central portion 38 of the retainer 12. Each of the rocker arm shafts 20, 22 includes apertures 58 therethrough correspondingly disposed in relation to the apertures 56 of the bosses 50 along one of the sides 34, 36 of the sheet-like body. The rocker arm shaft retainer 12 mates with the rocker arm shafts 20, 22 along the recesses 42 of the fingers 40. The rocker arms 24 are received in the slots 44 of the retainer 12, the apertures 58 of the rocker arm shafts 20, 22 are aligned with the apertures 56 of the bosses 40, and each of the fasteners 26 is inserted through one of the apertures 56 of the bosses 40 and corresponding apertures 58 of the rocker arm shafts 20, 22, thereby positioning the rocker arms 24 along each of the rocker arm shafts 20, 22.

The rocker arm shaft retainer 12 of the present invention reduces the number of members needed to retain the rocker arm shafts 20, 22 from, for example, a dozen or more down to one member. The reduction of the number of members reduces the cost of retaining the rocker arm shafts 20, 22 while also simplifying assembly of the engine. The reduction of the number of members per engine subassembly, as well as the ability to align the rocker arms 24 within that subassembly, aids in the installation of the subassembly to an engine. The rocker arm shaft retainer 12 also acts as an error-proofing device by eliminating the possibility of mixing differently sized rocker arm spacers used in conventional rocker arm shaft and rocker arm assemblies.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

I claim:

1. A rocker arm shaft and rocker arm assembly comprising:

a rocker arm shaft retainer including:

an elongated contoured sheet-like body having two opposite ends, two opposite sides longer in length than said ends, and a central portion between said sides;

a plurality of fingers extending from said central portion towards said sides, each finger having a contoured recess for engaging a rocker shaft;

said fingers defining slots for receiving rocker arms;

a plurality of thrust faces along edges of said fingers for axial positioning of rocker arms on a rocker shaft; and a plurality of bosses disposed on said fingers, each of said bosses having a generally flat surface and including an aperture therethrough;

two rocker arm shafts;

each of said rocker arm shafts including apertures therethrough correspondingly disposed in relation to said apertures of said bosses along one of said sides of said sheet-like body;

a plurality of rocker arms disposed on each of said rocker arm shafts;

a plurality of fasteners; and a lifter oil manifold;

said rocker arm shaft retainer mating with said rocker arm shafts along said recesses of said fingers;

wherein said rocker arms are received in said slots of said retainer, said apertures of said rocker arm shafts are aligned with said apertures of said bosses, and each of said fasteners is inserted through one of said apertures of said bosses and corresponding apertures of said rocker arm shafts, thereby positioning said rocker arms along each of said rocker arm shafts, and at least some of said fasteners are received in said manifold, thereby fastening said retainer and said rocker arm shafts to said manifold and retaining said rocker arm shafts.

2. The rocker arm shaft and rocker arm assembly of claim 1, further including a lifter oil feed pipe spacedly mounted to said lifter oil manifold, said lifter oil feed pipe being disposed above said retainer.

3. The rocker arm shaft and rocker arm assembly of claim 2, wherein said central portion of said retainer further includes at least one opening therein, and said assembly includes at least one mounting for said lifter oil feed pipe that extends through said opening.

* * * * *